US006634936B2

(12) United States Patent
Jensen et al.

(10) Patent No.: US 6,634,936 B2
(45) **Date of Patent: *Oct. 21, 2003**

(54) CHEMICAL MECHANICAL PLANARIZATION OR POLISHING PAD WITH SECTIONS HAVING VARIED GROOVE PATTERNS

(75) Inventors: Alan J. Jensen, Troutdale, OR (US); Brian S. Thornton, Santa Clara, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/870,212

(22) Filed: May 30, 2001

(65) Prior Publication Data

US 2001/0031615 A1 Oct. 18, 2001

Related U.S. Application Data

(63) Continuation of application No. 09/316,166, filed on May 21, 1999.

(51) Int. Cl.[7] ..... B24B 21/00
(52) U.S. Cl. ..... 451/296; 451/527
(58) Field of Search ..... 451/296, 168, 451/303, 307, 285, 286, 287, 288, 527, 529, 530, 537

(56) References Cited

U.S. PATENT DOCUMENTS

| | | | | |
|---|---|---|---|---|
| 5,177,908 A | | 1/1993 | Tuttle | |
| 5,297,364 A | | 3/1994 | Tuttle | |
| 5,441,598 A | | 8/1995 | Yu et al. | |
| 5,489,233 A | | 2/1996 | Cook et al. | |
| 5,534,106 A | | 7/1996 | Cote et al. | |
| 5,645,469 A | | 7/1997 | Burke et al. | |
| 5,650,039 A | | 7/1997 | Talieh | |
| 5,672,095 A | * | 9/1997 | Morimoto et al. | 451/41 |
| 5,690,540 A | | 11/1997 | Elliott et al. | |
| 5,722,877 A | * | 3/1998 | Meyer et al. | 451/41 |
| 5,842,910 A | | 12/1998 | Krywanczyk et al. | |
| 5,984,769 A | | 11/1999 | Bennett et al. | |
| 6,077,153 A | | 6/2000 | Fujita et al. | |
| 6,093,651 A | | 7/2000 | Andideh et al. | |
| 6,120,366 A | | 9/2000 | Lin et al. | |
| 6,261,168 B1 | * | 7/2001 | Jensen et al. | 451/527 |

FOREIGN PATENT DOCUMENTS

| | | |
|---|---|---|
| EP | 0 878 270 A2 | 11/1998 |
| WO | WO 99/06182 | 2/1999 |

OTHER PUBLICATIONS

English Abstract for JP6–47678 published Feb. 22, 1994.
International Search Report dated Aug. 22, 2000 for corresponding PCT application PCT/US00/13328.
Copy of currently pending claim in co–pending application Ser. No. 09/905,332 filed Jul. 13, 2001.

* cited by examiner

*Primary Examiner*—Dung Van Nguyen
(74) *Attorney, Agent, or Firm*—Brinks Hofer Gilson & Lione

(57) ABSTRACT

A CMP polishing pad improves overall material removal rate uniformity by combining multiple polishing pad sections in a serially linked manner, where the polishing pad sections are characterized by at least two different material removal rate profiles. The polishing pad is designed by determining a wafer polishing profile for each of a group of polishing pads where each polishing pad has a unique groove configuration, determining a combination of polishing pad segments, each of the segments constructed with one of the unique groove configurations, that will combine to achieve an improved uniformity in the polishing profile, and manufacturing a polishing pad having pad sections corresponding to the analytically determined pad sections.

16 Claims, 6 Drawing Sheets

CHEMICAL MECHANICAL PLANARIZATION OR POLISHING PAD WITH SECTIONS HAVING VARIED GROOVE PATTERNS

CROSS-REFERENCE TO RELATED APPLICATIONS

This application is a continuation of application Ser. No. 09/316,166, filed May 21, 1999, (pending), which is hereby incorporated by reference herein.

FIELD OF THE INVENTION

The present invention relates to a polishing pad for use in chemical mechanical planarization applications. More particularly, the present invention relates to a pad used in the chemical mechanical planarization or polishing of semiconductor wafers.

BACKGROUND OF THE INVENTION

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer.

The type of polishing pad used on the wafer polisher can greatly affect the removal rate profile across a semiconductor wafer. Ideally, a semiconductor wafer processed in a wafer polisher will see a constant removal rate across the entire wafer surface. Many polishing pads have been designed with one particular pattern of channels or voids to attempt to achieve a desired removal rate. These existing polishing pads often have a signature removal rate pattern that, for example, may remove material from the edge of a semiconductor wafer faster than the inner portion of the wafer. Accordingly, there is a need for a polishing pad that will enhance uniformity across the surface of a semiconductor wafer.

SUMMARY OF THE INVENTION

According to a first aspect of the present invention, a polishing member is provided having a linear belt movable in a linear path. At least two serially linked polishing pad sections are attached to the belt. The polishing pad sections include a first polishing pad section having a first groove pattern formed in a side of the first polishing pad section. The first groove pattern is preferably made up of a plurality of grooves. A second polishing pad section has a non-grooved side opposite the linear belt.

According to a second aspect of the present invention, a polishing pad for chemical mechanical planarization of semiconductor wafers includes a plurality of serially linked polishing pad sections forming a linear belt. The plurality of serially linked polishing pad sections includes first and second polishing pad sections having respective first and second groove patterns. In one embodiment, each of the groove patterns is preferably oriented parallel to the linear path of the pad. In another embodiment, the pad sections may have non-parallel grooves.

According to another aspect of the present invention, a method of producing a linear chemical mechanical planarization polishing pad having a plurality of polishing pad sections includes the step of empirically measuring the material removal rate profile on a semiconductor wafer for each of a plurality of groove patterns used in chemical mechanical planarization polishing pads, wherein each of the plurality of groove patterns is a unique groove pattern. The measured material removal rate profile for each of the plurality of groove patterns is then compared and a determination is made as to an appropriate combination of the different groove patterns to achieve improved removal rate uniformity across a semiconductor wafer. After determining the necessary combination, a polishing pad comprised of at least two serially linked polishing pad sections is fabricated, where at least two of the polishing pad sections include a different one of the selected groove patterns.

DETAILED DESCRIPTION OF THE PRESENTLY PREFERRED EMBODIMENTS

One important factor in a chemical mechanical planarization (CMP) process is the uniformity of the resulting polish across the surface of a semiconductor wafer. By leaving uniform material thickness at all points on the wafer after completion of the polishing process, an integrated circuit die on the wafer will be more likely to maintain the same performance characteristics independent of where it originated on the wafer. As set forth below, a CMP polishing pad according to an embodiment of the present invention provides improved uniformity in removal rates and can lead to improved manufacturing process control and increased wafer yield.

Figure 1:
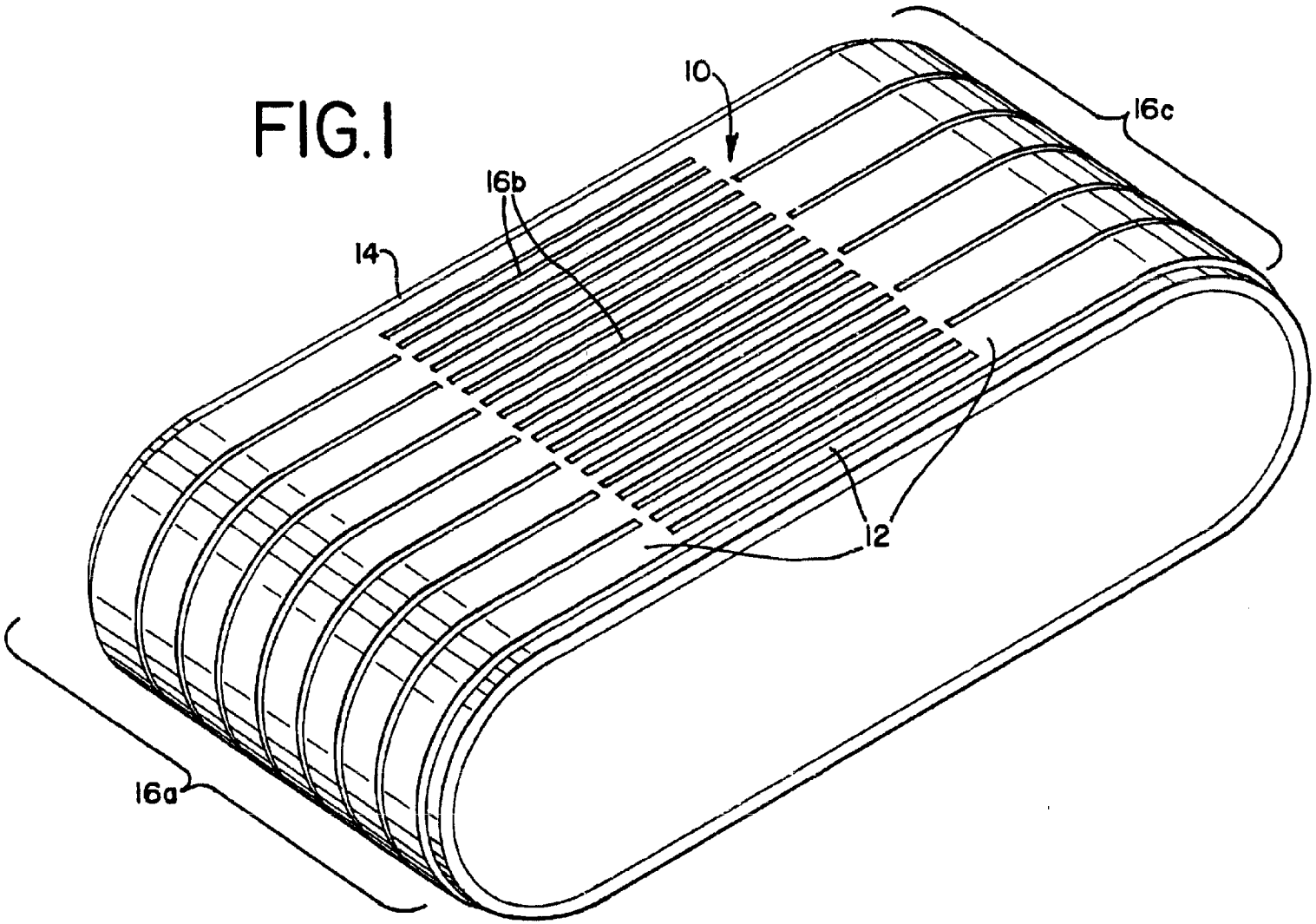
FIG. 1 is a perspective view of a polishing member having a polishing pad according to a preferred embodiment of the present invention.

FIG. 1 illustrates a presently preferred embodiment of a CMP polishing pad 10 according to the present invention. The polishing pad 10 includes a plurality of polishing pad sections 12. Each polishing pad section 12 is positioned adjacent to the next so that the sections form an unbroken, serially linked chain on the supporting linear belt 14. Each polishing pad section is formed with its own respective groove pattern 16*a–c*. Also, each groove pattern 16*a–c* is arranged parallel to the direction of motion of the linear belt 14. Each pad section 12 may be constructed from a separate piece of pad material and connected together to form the complete polishing pad 10. Alternatively, the polishing pad sections 12 may be manufactured in a single piece of material. The polishing pad sections may either be mounted on a separate belt, as shown in FIG. 1, or may form a polishing pad that is a stand-alone belt.

Figure 2:
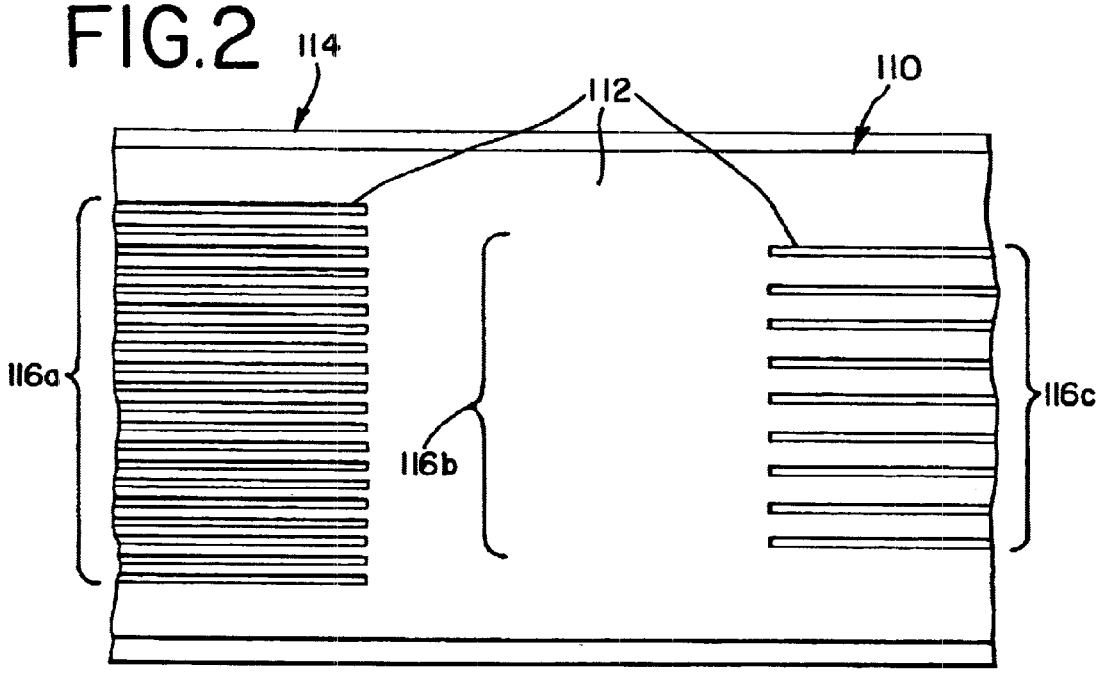
FIG. 2 is a partial plan view of an alternative embodiment of the polishing pad of FIG. 1.

Referring to FIG. 2, an alternative embodiment is shown where the polishing pad 110 includes sections 112 having groove patterns 116*a*, 116*c* and a section completely lacking grooves (i.e. an unbroken polishing pad surface) 116*b*. Again, the grooves are arranged parallel to the direction of motion of the linear belt 114. Each groove pattern, in one preferred embodiment, is defined by a width, a depth, and a pitch.

Figure 3:
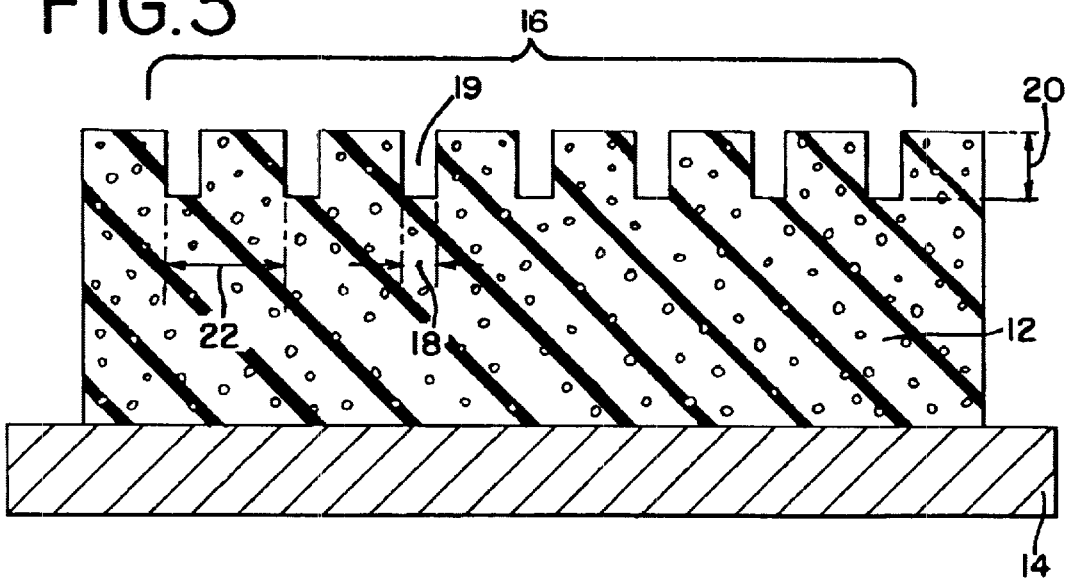
FIG. 3 is a cross-sectional view of a grooved polishing pad section suitable for use in the polishing pad of FIG. 1 or 2.

As illustrated in FIG. 3, the width 18 of a groove 19 is the distance between opposing parallel walls of the groove. The depth 20 is the distance from the outer surface of the polishing pad to the bottom of the groove, and the pitch 22 is the distance from a first wall of a first groove to a respective first wall of the immediately adjacent groove. In the embodiments of FIGS. 1–3, the groove pattern differs between pad sections but is preferably uniform within a given pad section 12, 112 so that the width, depth and pitch are the same for grooves within a particular pad section. In other embodiments, the groove pattern within a particular pad section may include a width, depth, and pitch that varies between grooves in that pad section. Additionally, while the grooves are preferably formed having a rectilinear cross-section, the grooves may be formed having slanted or curved walls. For purposes of this specification, a groove is defined as a channel that is cut or formed in the pad material where the length of the channel is greater than its width. A groove may or may not extend the entire length of a pad section.

Figure 4:
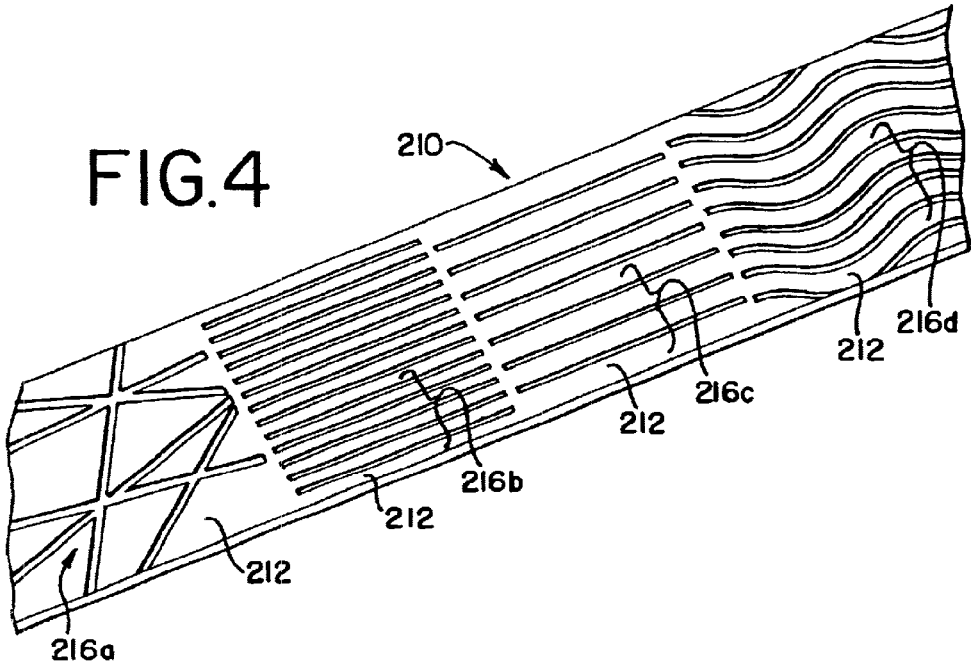
FIG. 4 is a partial plan view of a second alternative embodiment of the polishing pad of FIG. 1.

In other embodiments of linear semiconductor polishing or planarization pads, the grooves in a particular pad section may be non-parallel. Referring to the embodiment of FIG. 4, a linear polishing pad 210 is shown including a polishing pad section 212 with a non-parallel groove pattern 216*a*. The non-parallel groove pattern 216*a* may have grooves that intersect. The polishing pad section 212 with the non-parallel groove pattern 216*a* may be combined with other polishing pad sections 212 having parallel groove patterns 216*b*–216*d*. Other combinations, such as a polishing pad with all pad sections having a different, non-parallel groove pattern or a polishing pad with some pad sections having non-parallel grooves and other pad sections having non-grooved surfaces, are contemplated. As shown in the embodiment of FIG. 4, the parallel groove pattern may include pattern of serpentine grooves 216*d* or other curves that are disposed in either a parallel or a non-parallel relationship to each other. One or more polishing pad sections may have an embossed pattern of circular voids or dimples formed in the pad material, rather than grooves, in yet another embodiment.

Figure 5:
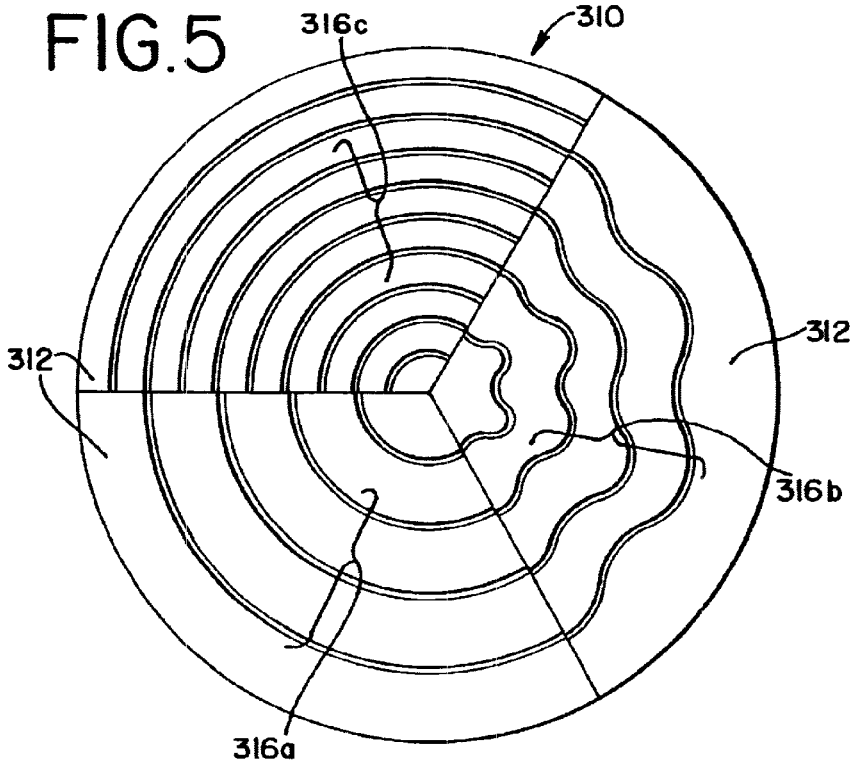
FIG. 5 is a plan view of a rotary polishing pad according to a preferred embodiment.

According to another embodiment, the semiconductor polishing pad may be a rotary polishing pad. FIG. 5 illustrates one rotary polishing pad 310 having a plurality of wedge-shaped sections 312 that are serially linked such that a semiconductor wafer is sequentially presented with a different section as the rotary polishing pad is rotated. Each section 312 preferably has a different groove pattern 316*a*–316*c*. In one embodiment, one or more sections 312 may each have a groove pattern that includes a plurality of concentric arc segments (see groove patterns 316*a* and 316*c*) centered about the center of the rotary pad. In other embodiments, one or more sections 312 may have a groove pattern including a plurality of non-concentric groove patterns.

One suitable pad material for use in constructing the polishing pad sections that make up the linear or rotary semiconductor polishing pad is a closed cell polyurethane such as IC1000 available from Rodel Corporation of Phoenix, Ariz. Although each pad section is preferably constructed of the same pad material, in other embodiments, one or more different pad materials may be used for each polishing pad section in the polishing pad. The pad materials may also be selected to have a different hardnesses or densities. In one preferred embodiment, the pad materials may have a Durometer hardness in the range of 50–70, a compressibility in the range of 4%–16%, and a specific gravity in the range of 0.74–0.85. The grooves may be fabricated in the pad material using standard techniques used by any of a number of commercial semiconductor wafer polishing pad manufacturers such as Rodel Corp.

Referring to FIGS. 1, 2, 4 and 8, the polishing pad 10, 110, 210 may be mounted to a linear belt 14, 114 in one embodiment and utilized in a linear semiconductor wafer polisher 250 such as the TERES™ polisher available from Lam Research Corporation of Fremont, Calif. In operation, the pad 10, 110, 210 is continuously moved along a linear direction while a semiconductor wafer holder 252 presses a semiconductor wafer W against the surface of the pad. The semiconductor wafer holder 252 may also rotate the wafer W while holding the wafer against the pad.

The pad 10, 110, 210, along with a slurry that is both chemically active and abrasive to the wafer surface, is used to polish layers on the wafer. Any of a number of known polishing slurries may be used. One suitable slurry is SS25 available from Cabot Corp. The groove pattern 16, 116, 216 including the absence grooves, on a pad section changes the ability of the pad to transport slurry underneath the wafer and therefore the groove pattern can affect the material removal rate profile as measured on a cross section of a wafer.

One preferred method for creating a linear CMP polishing pad having a substantially uniform material removal rate profile for a semiconductor wafer is described below. First, several polishing pads, each having a single groove pattern and each completely covering the circumference of a different belt, are each used to polish a semiconductor wafer for a predetermined time. The same wafer polisher, preferably the TERES™ polisher available from Lam Research Corporation, is used to test each of the polishing pads. After polishing a semiconductor wafer with a particular polishing pad, the amount of material removed is measured at various points across the diameter of the wafer and recorded in a database on a computer. The removal rates are then compared at the respective measurement points used for each semiconductor wafer. Using the comparison data, a determination is made as to what combination of groove patterns, and what length of each particular groove pattern, is predicted to produce a uniform material removal rate across an entire semiconductor wafer. In one preferred embodiment, the comparison of the material removal rates and determination of the appropriate combination of groove patterns may be accomplished using a personal computer running a program written in Excel by Microsoft Corporation.

After calculating the predicted polishing pad sections that produce a polishing pad having a substantially uniform material removal rate across an entire wafer, a polishing pad is fabricated using commonly known fabrication techniques so that the appropriate section lengths for each chosen groove pattern are combined on a single belt. In one embodiment, where a single pad material is used, the pad may be a single, continuous strip having the appropriate groove patterns and lengths formed in it. In another embodiment, separate pieces of pad material, each having its own groove pattern, may be linked together on a single belt.

Figure 6:
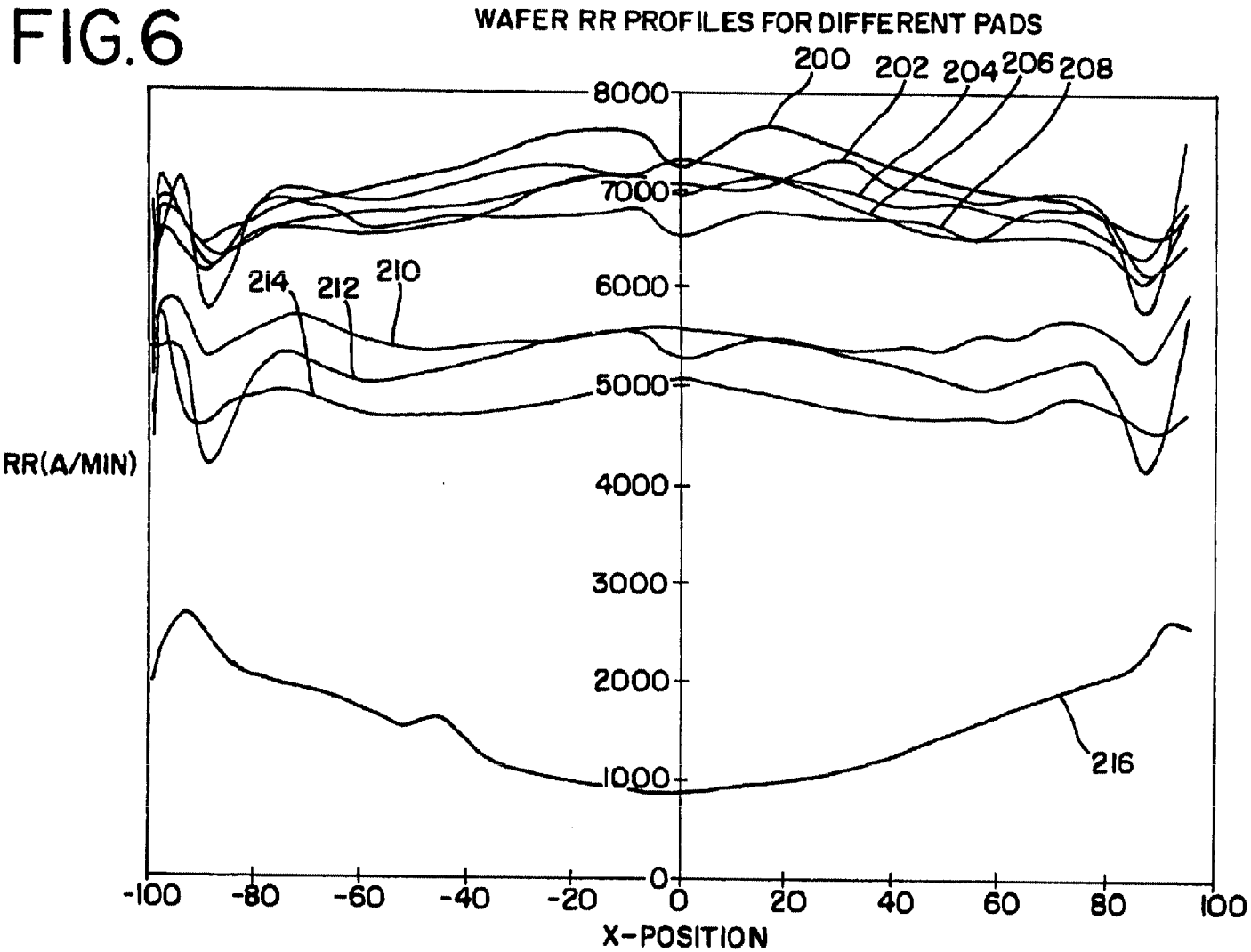
FIG. 6 is a graphical representation of material removal rate measurements made according to a preferred embodiment of the method of the present invention.

A graphical representation of material removal rates for various groove patterns is illustrated in FIG. 6. The x-axis of the graph in FIG. 6 represents the measurement point along the diameter of the semiconductor wafer in millimeters from the center of the wafer. The y-axis represents the measured removal rate in angstroms per minute. Each trace on the graph represents the measured removal rate for a pad having a particular grove pattern. The downforce (pressure applied to the semiconductor against the pad) for all measurements was 5 pounds per square inch, while the linear speed of the pad and the rotational speed of the wafer holder were 400 feet per minute and 20 revolutions per minute, respectively. Beginning with the uppermost trace in FIG. 6, the groove patterns corresponding to the illustrated material removal rates are as follows:

| Reference Number | Groove Pattern (width × depth × pitch) (all in thousandths of an inch) |
|---|---|
| 200 | K-Groove ™ |
| 202 | 10 × 20 × 40 |
| 204 | 10 × 20 × 100 |
| 206 | 20 × 20 × 50 |
| 208 | 10 × 10 × 100 |
| 210 | 20 × 20 × 40 |
| 212 | 10 × 20 × 50 |
| 214 | 20 × 20 × 100 |
| 216 | No Grooves In Pad |

As is apparent from the example of FIG. 6, the material removal rate and the removal rate profile vary significantly between the different groove patterns. By selecting several groove patterns and calculating a weighted average of removal rates at each point along the diameter of the wafer, where the weighting is based on the percentage of length of the complete pad that will be constructed from a pad section having the particular groove pattern, a predicted removal rate profile may be calculated. In a preferred embodiment, the grooves are oriented parallel to the direction of motion of the pad on the linear belt. While various other groove dimensions are contemplated, the groove dimensions are preferably within the range of 0–30 thousandths of an inch (mils) wide, 5–30 mils deep, and have a pitch in the range of 25–200 mils. The K-Groove™ trace 200 refers to a commercially available groove pattern from Rodel Corp.

Figure 7:
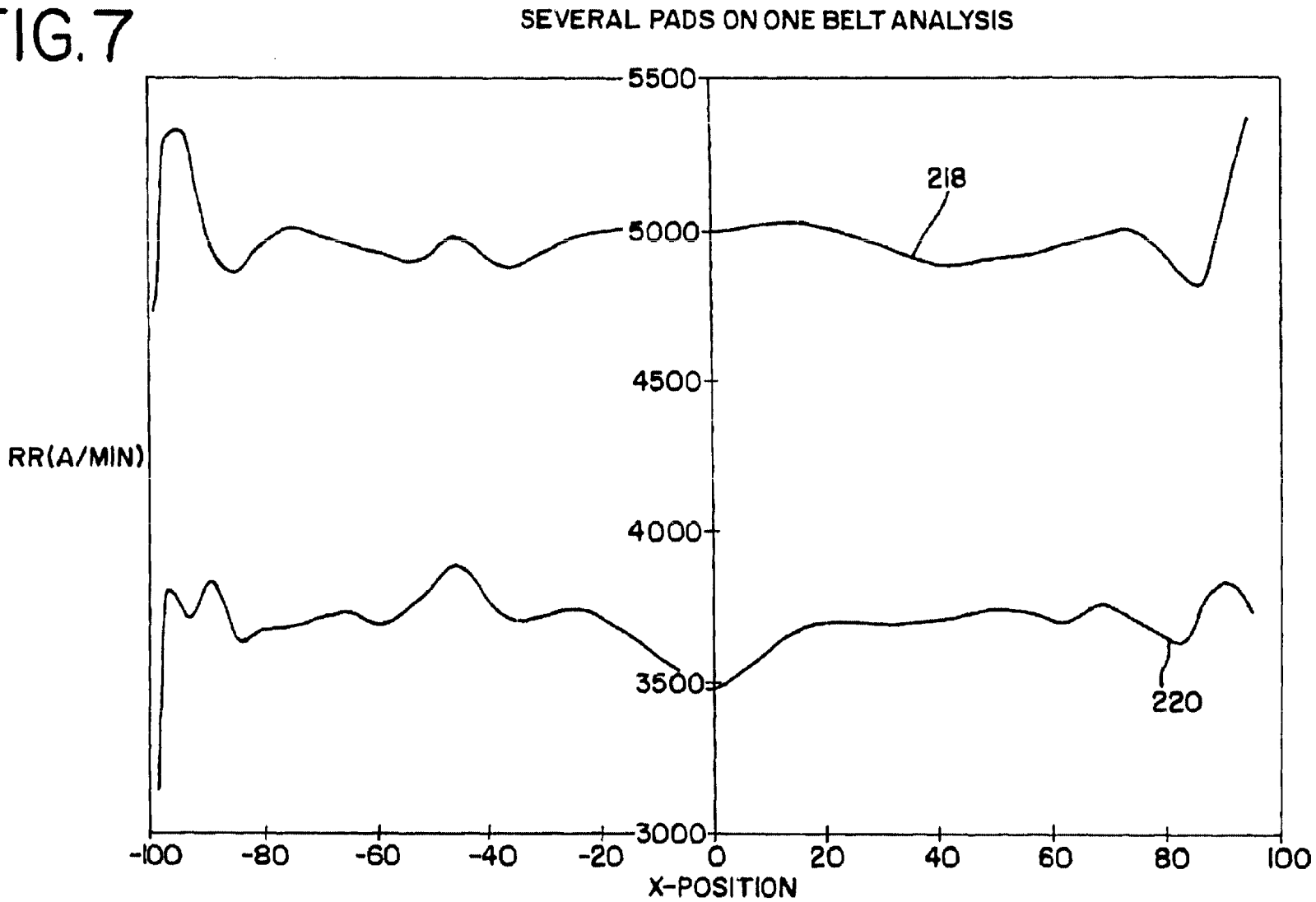
FIG. 7 is a graphical representation of the material removal rates obtained by combining selected polishing pad sections described in FIG. 4 according to a preferred embodiment.
Figure 8:
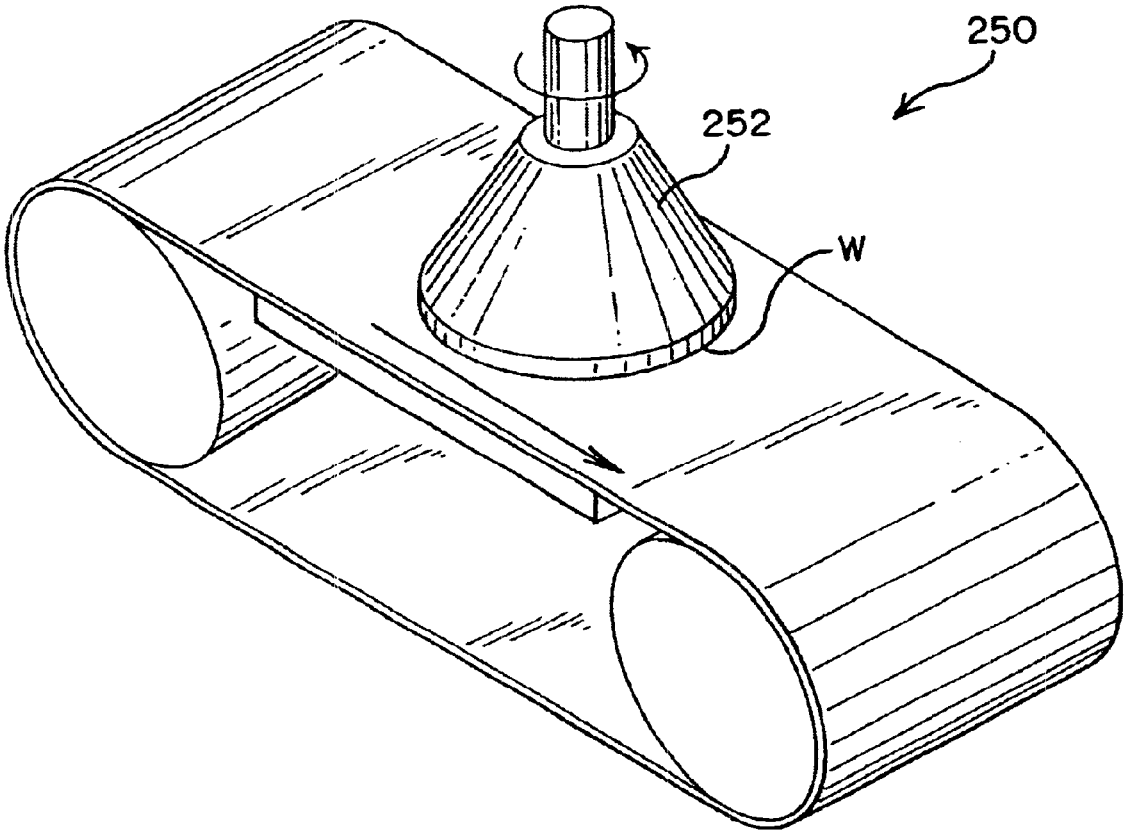
FIG. 8 is a perspective view of a linear polisher for use with a linear polishing pad.

FIG. 7 illustrates a predicted removal rate profile 218 and the actual removal rate profile 220 measured from a polishing pad fabricated according to the method described above. The polishing pad used to generate the removal rate profiles 218, 220 included three polishing pad sections having equal lengths and constructed out of the same polishing pad material. The first polishing pad section included a groove pattern of 0.010"×0.020"×0.100" (depth×width×pitch), the second polishing section included a groove pattern of 0.020"×0.020"×0.050", and the third polishing pad section had no grooves. Another polishing pad, fabricated according to a preferred embodiment of the present invention, having improved material removal rate uniformity along the entire width of the wafer, is made up of five polishing pad sections: no groove, 12×20×50, 20×20×50, 10×20×100, and 20×20×100 (where the dimensions are in thousandths of an inch and refer to width×depth×pitch).

From the foregoing, a polishing pad and a method of making the same have been described. The method takes advantage of the different material removal rate profiles of different groove patterns and optimizes a combination of the available groove patterns to form a composite pad having at least two polishing pad sections with different groove patterns. The method provides for comparing removal rate profiles for different groove patterns and mathematically optimizing a resulting combination of polishing pad sections on a single platform to improve the removal rate profile. The resulting pad preferably has a more uniform material removal rate across a semiconductor wafer.

A CMP polishing pad is also disclosed having a plurality of serially linked polishing pad sections. The plurality of pad sections may form a linear belt or may be mounted on a separate linear belt. Also, the pad sections may form a rotary polishing pad. Each polishing pad section includes a different groove pattern that, in a first embodiment, is made up of grooves oriented parallel to the direction of travel of the pad and, in another embodiment, may include grooves that are not parallel to the direction of travel.

It is intended that the foregoing detailed description be regarded as illustrative rather than limiting, and that it be understood that the following claims, including all equivalents, are intended to define the scope of this invention.

We claim:

1. A chemical mechanical planarization system for chemical mechanical planarization of a semiconductor wafer, the system comprising:

a wafer polisher;

a polishing pad associated with the wafer polisher, wherein the polishing pad comprises:

at least two serially linked polishing pad sections formed of an abrasive material, the polishing pad sections having a first polishing pad section having a first groove pattern formed In a side of the first polishing pad section adapted to contact the semiconductor wafer, wherein the first groove pattern comprises a plurality of grooves, and a second polishing pad section having a second groove pattern comprised of a plurality of grooves in a side of the second polishing pad section adapted to contact the semiconductor wafer, wherein the first groove pattern differs from the second groove pattern; and a wafer holder configured to hold the semiconductor wafer against the polishing pad.

2. The system of claim 1, wherein the first groove pattern comprises a plurality of non-parallel grooves formed in the abrasive material.

3. The system of claim 2, wherein the second groove pattern comprises a plurality of parallel grooves formed in the abrasive material.

4. The system of claim 1, wherein the polishing pad comprises a linear polishing pad.

5. The system of claim 1, wherein the polishing pad comprises a rotary polishing pad and wherein each polishing pad section comprises a wedge-shaped section.

6. The system of claim 1, wherein the first groove section comprises a plurality of grooves formed in the abrasive material, the plurality of grooves having a constant width and a constant depth.

7. The system of claim 1 wherein each of the plurality of grooves further comprises a constant spacing between adjacent grooves.

8. The system of claim 1, wherein the wafer polisher comprises a linear wafer polisher.

9. A chemical mechanical planarization system for chemical mechanical planarization of semiconductor wafers, the system comprising:

a wafer polisher;

a polishing pad associated with the wafer polisher, the polishing pad having at least two serially linked polishing pad sections wherein each of the polishing pad sections are arranged sequentially along an intended direction of motion of the polishing pad, the polishing pad sections comprising:

a first polishing pad section having a first groove pattern formed in a side of the first polishing pad section adapted to contact a semiconductor wafer, wherein the first groove pattern comprises a first plurality of grooves; and a second polishing pad section having a second plurality of grooves in a side of the second polishing pad section adapted to contact the semiconductor wafer, wherein the first groove pattern differs from the second groove pattern; and a wafer holder configured to hold the semiconductor wafer against the polishing pad.

10. The system of claim 9, wherein at least one of the polishing pad sections comprises an abrasive material.

11. The system of claim 9, wherein the first plurality of grooves is oriented parallel to the intended direction of motion of the polishing pad.

12. The system of claim 9, wherein the first polishing pad section comprises a first hardness and the second polishing pad section comprises a second hardness, and wherein the first hardness differs from the second hardness.

13. The system of claim 9, wherein the first polishing pad section comprises a first density and the second polishing pad section comprises a second density, and wherein the first density differs from the second density.

14. The system of claim 9, wherein the at least two polishing pad sections comprise at least two different material removal profiles, and wherein the serially linked polishing pad sections are configured to produce a polishing member having a substantially uniform material removal profile.

15. The system of claim 9, wherein each of the first plurality of grooves comprises:

a rectangular cross-section having a depth defined by a distance from the surface of the first polishing pad section, a width defined by a distance perpendicular to the depth measured from a first groove wall to a second groove wall, and a pitch spacing defined by a distance between the first groove wall of a first groove in the first plurality of grooves and a respective first wall of a groove immediately adjacent to the first groove.

16. The system of claim 9, wherein the wafer polisher comprises a linear wafer polisher.

* * * * *

UNITED STATES PATENT AND TRADEMARK OFFICE

CERTIFICATE OF CORRECTION

PATENT NO. : 6,634,936 B2
DATED : October 21, 2003
INVENTOR(S) : Alan J. Jensen et al.

It is certified that error appears in the above-identified patent and that said Letters Patent is hereby corrected as shown below:

Column 1,
Line 54, after "pattern formed" delete "In" and substitute -- in -- in its place.

Signed and Sealed this

Thirty-first Day of August, 2004

JON W. DUDAS
*Director of the United States Patent and Trademark Office*